United States Patent [19]

Martin

[11] Patent Number: 4,527,738

[45] Date of Patent: Jul. 9, 1985

[54] MODULAR UNIT FLUID PUMP-INJECTOR

[75] Inventor: James L. Martin, Chillicothe, Ill.

[73] Assignee: Caterpillar Tractor Co., Peoria, Ill.

[21] Appl. No.: 654,521

[22] Filed: Sep. 25, 1984

Related U.S. Application Data

[63] Continuation of Ser. No. 389,636, Jun. 18, 1982, abandoned.

[51] Int. Cl.[3] ..... F02M 47/02

[52] U.S. Cl. ..... 239/90; 239/95

[58] Field of Search ..... 239/90, 91, 95, 533.3–533.12

[56] References Cited

U.S. PATENT DOCUMENTS

| | | | |
|---|---|---|---|
| 2,082,808 | 6/1937 | Murphy . | |
| 2,096,711 | 10/1937 | Fielden | 239/95 |
| 2,144,861 | 1/1939 | Truxell | 123/32 |
| 2,408,288 | 9/1946 | Bremser | 239/95 |
| 2,560,799 | 7/1951 | Johnson . | |
| 2,727,094 | 2/1942 | Murphy . | |
| 3,006,556 | 10/1961 | Shade et al. | 239/88 |
| 3,055,593 | 9/1962 | May et al. | 239/87 |
| 3,368,491 | 2/1968 | Shook et al. | 103/41 |
| 3,439,876 | 4/1969 | Shook | 239/88 |
| 4,081,140 | 3/1978 | Kranc | 239/533.9 |
| 4,418,664 | 12/1983 | Bellmann | 123/273 |

FOREIGN PATENT DOCUMENTS

| | | | |
|---|---|---|---|
| 2024315 | 1/1980 | United Kingdom | 239/533.3 |

*Primary Examiner*—Andres Kashnikow
*Assistant Examiner*—Michael J. Forman
*Attorney, Agent, or Firm*—Anthony N. Wołoch

[57] ABSTRACT

A modular unit fluid pump-injector for pumping and injecting fuel into an engine combustion chamber is disclosed and includes a first retainer (68) for sealably and removably retaining the pump cylinder (32) against the housing (18) and a second retainer (148) for sealably and removably retaining an encapsulated injector assembly (28) against the first retainer (68).

Unlike conventional unit fluid pump-injectors which have a single elongated sleeve-type nut enclosing and clamping a stacked plurality of both pump and injector components, the modular design is less prone to excessive fuel leakage and the plunger binding during assembly. The modular design also facilities easy assembly or removal of the encapsulated injector assembly (28) to or from the first retainer (68) without altering the position or arrangement of the pump elements (32,34) relative to the first retainer (68).

6 Claims, 2 Drawing Figures

MODULAR UNIT FLUID PUMP-INJECTOR

This is a continuation of Ser. No. 389,636, filed June 18,1982, now abandoned.

TECHNICAL FIELD

This invention relates generally to fluid pumping and injecting apparatus and more particularly to unit fuel pump-injectors for delivering fuel directly to the combustion chambers of a compression-ignition engine.

BACKGROUND ART

In prior art unit fuel pump-injectors, such as disclosed in U.S. Pat. No. 3,006,556 issued to Shade et al on Oct. 31, 1961, it has been conventional to provide a single elongated sleeve-type nut which substantially encloses a stacked plurality of both injector and pump components. The nut is threadably mated and tightened to a housing in order to retain the substantially enclosed components against separation and thereby join the respective abutting high pressure sealing end surfaces of these internal components.

A number of problems are encountered with this typical unit fuel pump-injector configuration. First, a relatively large number of internal components, such as a spray tip, spring cage, spring retainer, and fuel pump cylinder, are stacked and clamped between the single nut and the housing. Thus, the chances of successfully assembling the pump-injector and tightening the nut, without undesirably binding the reciprocable plunger in the pump cylinder, are very sensitive to the quality of surface finish and parallelism of each of the numerous abutting high pressure sealing end surfaces of the components.

Even if the required quality of surface finish and parallelism is achieved during manufacture of the components, the problem of the plunger binding in the pump cylinder can arise in attempting to reassemble a used and worn pump-injector that had been disassembled for cleaning or rebuilding. In such cases, the nut must be loosened or removed and the internal components must be shifted around several times or even relapped at their end surfaces before the nut can be properly tightened.

Second, the amount of high pressure fuel leakage between the internal components is also very sensitive to the quality of surface finish and parallelism of the numerous abutting sealing end surfaces of those parts. Excessive fuel leakage erodes and thereby irreparably damages the sealing end surfaces and also helps cause undesirably large tolerances on injector fuel flow rate and injector valve opening pressure.

Third, the entire pump-injector must be disassembled for servicing or rebuilding even though it is usually only the spray tip of the injector assembly that requires replacement or cleaning since only the spray tip is directly exposed to the severe environment of the engine combustion chamber. The combustion byproducts build up carbon and corrosive elements in the seat area between the spray tip and nut, in addition to the spray tip orifices, making it difficult to disassemble and clean the spray tip and nut. Conversely, the injector assembly of the pump-injector must be disassembled even though it may be only the pump assembly that requires servicing.

Fourth, evaluation and quality control of performance parameters such as fuel injector flow rate, fuel internal leakage rate, and injector valve opening pressure of the pump-injector is time consuming since the entire pump-injector must be carefully assembled, bench tested, and then completely disassembled in order to substitute injector spring shims or other internal components which will bring the parameters within acceptable tolerances.

In U.S. Pat. No. 2,560,799 issued to Johnson on July 17, 1951 there is disclosed a capsule which contains an injection valve and nozzle assembly to permit the assembly to be bench tested and observed in observation without connecting it to an engine. However, these teachings have never been adapted or applied to an injector assembly of a unit fuel pump-injector.

The present invention is directed to overcoming one or more of the problems as set forth above.

DISCLOSURE OF THE INVENTION

In one aspect of the present invention a unit fluid pump-injector is disclosed having a housing, a pump assembly including a pump cylinder, a first means for removably retaining the pump cylinder against the housing, an injector assembly, and a second means for removably retaining the injector assembly against the first means so that the injector assembly may be removed from or assembled to the unit fluid pump-injector without disturbing the pump assembly relative to the first retaining means.

Conventional unit fuel pump-injectors have a single elongated sleeve-type nut which retains a stacked plurality of both injector and pump components against a housing. Such a configuration is difficult to assemble and service since all the high pressure sealing end surfaces of the numerous abutting internal components must accurately fit together before the nut can be properly tightened. Also servicing of only either the pump or injector assembly requires disassembly of the entire pump-injector.

The present invention provides a modular unit fluid pump-injector having two sets of joints for separately sealably clamping the internal components thereby facilitating easier assembling and servicing of the pump-injector. With fewer internal parts clamped between each joint, the pump-injector is less prone to high pressure fluid leakage and having the plunger bind in the pump cylinder. Also, either the pump or injector assembly can be serviced without disturbing the other one relative to the first retaining means.

BEST MODE FOR CARRYING OUT THE INVENTION

Figure 1:
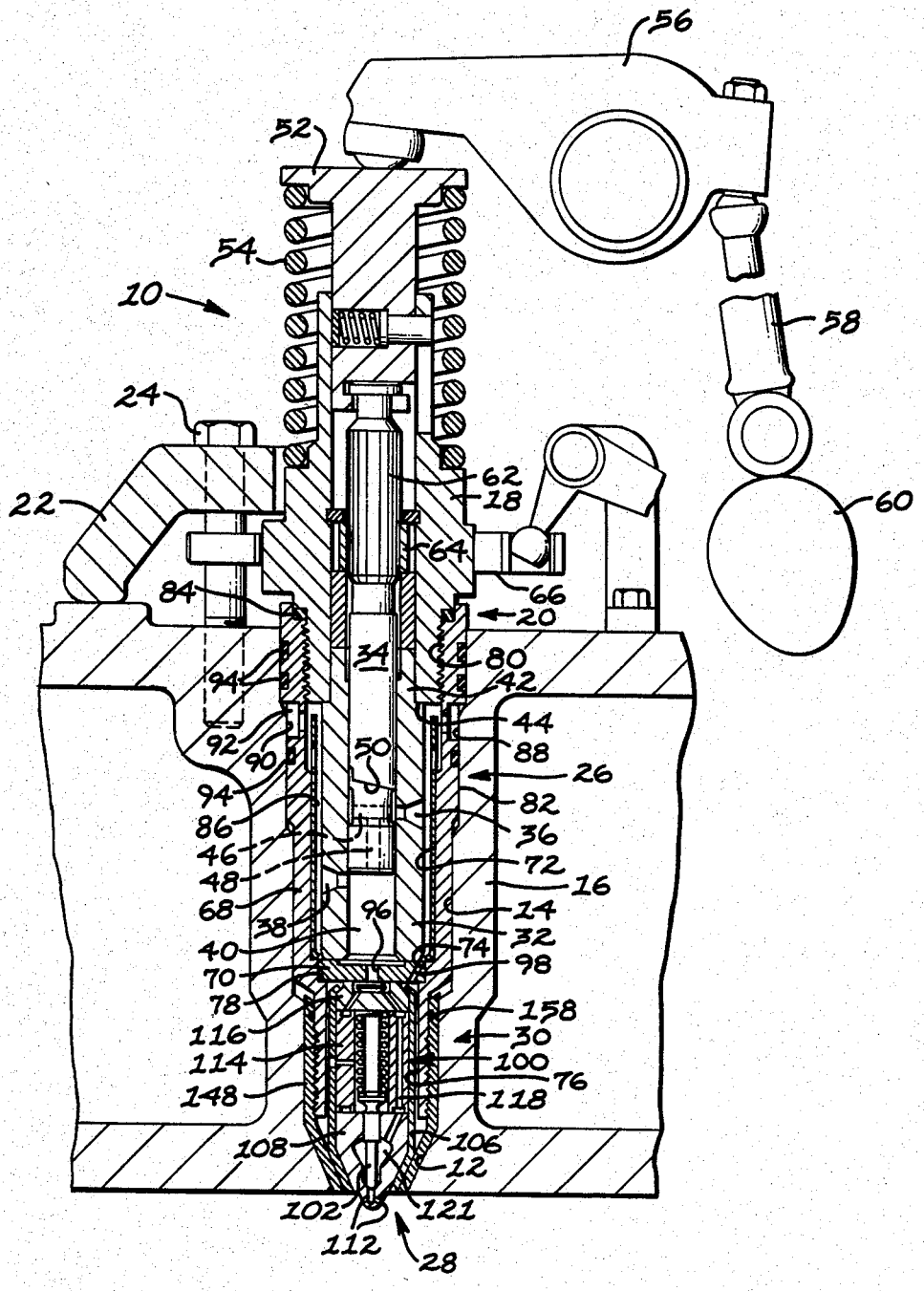
FIG. 1 is a diagrammatic cross-sectional view of the present invention as incorporated in a cylinder head of an internal combustion engine.
Figure 2:
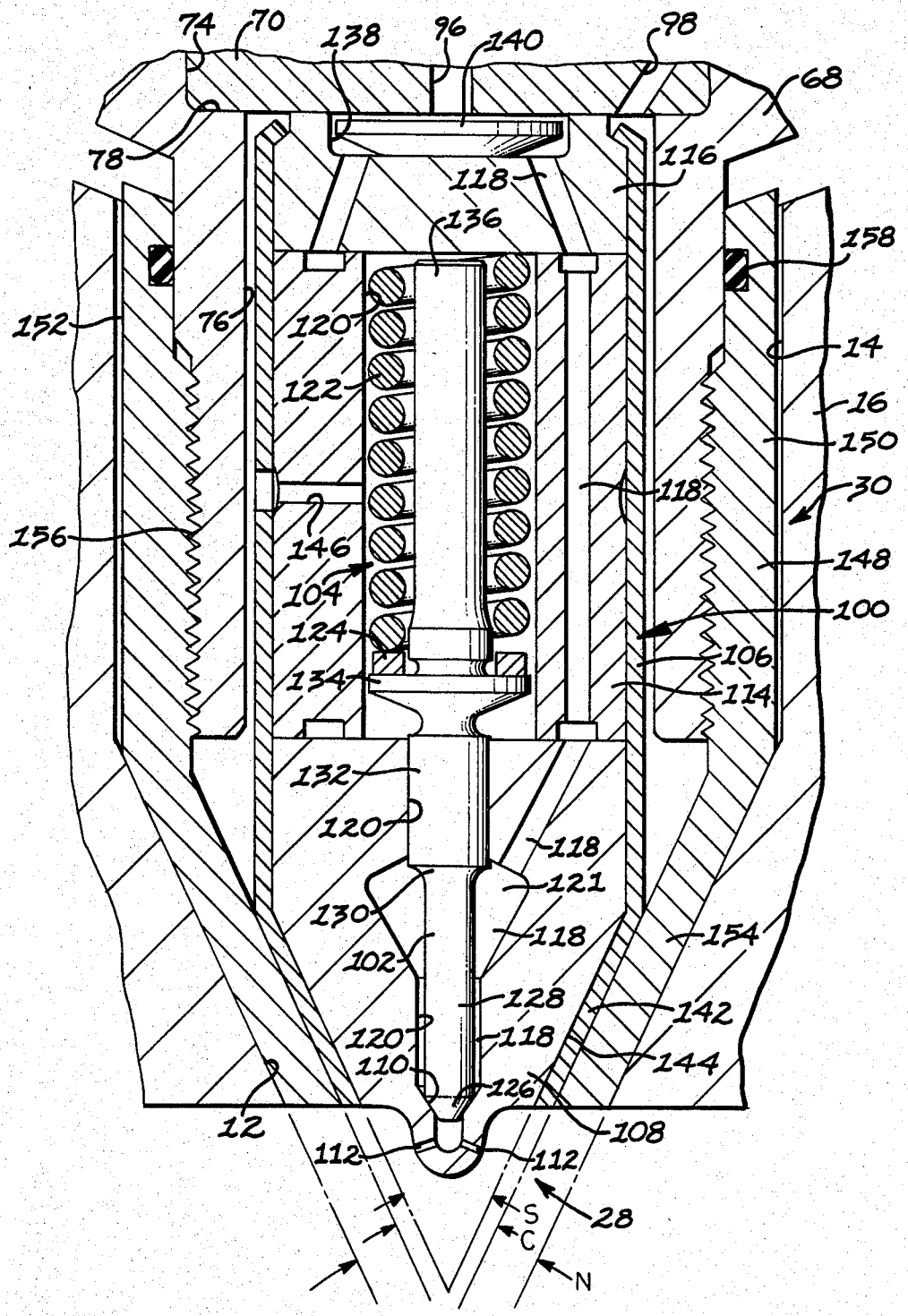
FIG. 2 is a diagrammatic enlarged partial view of FIG. 1 in the area of the injector assembly.

Referring to FIGS. 1 and 2 wherein similar reference numbers designate the same parts in the two views, the preferred embodiment of a unit fluid pump-injector 10 is shown after it has been assembled and then seated against an internal frusto-conical seat or surface 12 located within a stepped bore 14 of a cylinder head 16.

The upper portion of the pump-injector is conventional and comprises a housing 18 and a pump assembly 20. As is well known in the art, a two-prong clamp 22 and a bolt 24 fasten the housing 18 to the cylinder head 16.

The lower portion of the pump-injector 10 is unconventional and comprises a first means 26 for removably retaining a portion of the pump assembly 20 against the housing 18, an injector assembly 28, and a second means 30 for removably retaining the injector assembly 28 against the first retaining means 26 so that the injector assembly 28 may be removed from or assembled to the first retaining means 26 without requiring removal of the first retaining means 26 or even altering the position or arrangement of the pump assembly 20 relative to the first retaining means 26. Conversely the pump assembly 20 may be removed from or assembled to the first retaining means 26 without requiring removal of the second retaining means 30 or even altering the position or arrangement of the injector assembly 28 relative to the first retaining means 26.

The pump assembly 20 includes a pump cylinder or barrel 32 and a plunger 34. The pump cylinder 32 has upper and lower fluid ports 36,38 which communicate with an internal pumping chamber 40. The pump cylinder 32 also includes a reduced-diameter external end portion 42 which is piloted into the housing 18 and is sealably seated against the housing 18 at a housing shoulder 44.

The plunger 34, having an internal transverse channel 46 communicating with an internal longitudinal channel 48 and a helical fluid-metering groove 50, is slidably positioned within the pumping chamber 40 and is rotatably clasped by a bifurcated follower 52 which is reciprocable within the housing 18. A plunger return spring 54 cooperates with a pivotal rocker 56, a push rod 58, and an engine-driven rotatable-camshaft 60 in effecting reciprocation of the follower 52 and the plunger 34.

The plunger 34 is also rotatable within the pumping chamber 40 and has external splines 62 which slidably engage a rotatable pinion gear 64*a* and slidable rack 66 positioned in the housing 18.

The first retaining means 26 includes a first elongated sleeve-type nut or retainer 68, and a pump cylinder retainer 70. The first nut 68 has stepped large, intermediate, and small diameter bores 72,74,76, whereby the intermediate and small diameter bores 74,76 define a shoulder 78. The pump cylinder 32 is positioned in the large diameter bore 72 and the pump cylinder retainer 70 is positioned within the intermediate diameter bore 74 and is sealably seated between the pump cylinder 32 and the shoulder 78. The inner upper portion of the first nut 68 has a first internally-threaded portion 80 which is threadably mated to the housing 18 and the first nut 68 may be tightened by a wrench which engages a hexagonal-shaped exterior surface 82 on the first nut 68. An annular seal 84 is positioned adjacent the first threaded portion 80 and the housing 18. Once the first nut 68 is tightened, the pump cylinder 32 is sealably and removably retained between the housing shoulder 44 and the pump cylinder retainer 70.

Located concentrically between the first nut 68 and the pump cylinder 32 is an annular fluid reservoir 86 which communicates with upper and lower fluid ports 36,38. The first nut 68 also includes fluid supply and return ports 88,90 which communicate with the fluid reservoir 86 and also with an annular space 92 in the cylinder head bore 14 which communicates with a fluid supply manifold (not shown). A plurality of annular fluid seals 94 are externally positioned on the first nut 68 above and below the fluid supply ports 88,90.

The pump cylinder retainer 70 includes a centrally-located fluid delivery opening 96, which communicates with the pumping chamber 40 and the injector assembly 28, and a means 98 for returning fluid leakage from the small diameter bore 76 of the first nut 68 to the annular fluid reservoir 86. Preferably, the fluid leakage return means 98 is a passage angularly drilled in the pump cylinder retainer 70.

The injector assembly 28 is located partially in the small diameter bore 76 of the first nut 68 and includes a valve body 100, an inwardly-opening needle valve 102 positioned within the valve body 100, a means 104 for resiliently biasing the valve 102, and a formed case 106 sealably encircling or encapsulating the valve body 100 and the resilient biasing means 104 and retaining them against separation.

The valve body 100 includes a spray tip 108 having a valve seat 110 and at least one outlet or spray orifice 112, a spacer block or spring cage 114 sealably abutting the spray tip 108, and a spring retainer 116 abutting the spacer block 114 and also sealably abutting the pump cylinder retainer 70. Internal portions of the spray tip 108, spacer block 114, and spring retainer 116 define at least one fluid charge delivery passage 118 which communicates between the fluid delivery opening 96 of the pump cylinder retainer 70 and the outlet 112 of the spray tip 108. The middle portion of the spray tip 108 defines a cardioidal or heart-shaped fluid pressure chamber 121 in the passage 118.

The spray tip 108 and spacer block 114 define a centrally-disposed longitudinal stepped bore 120 which houses the slidable valve 102 and resilient biasing means 104. Preferably, the resilient biasing means 104 includes a helical compression spring 122 and optionally one or more annular spring-preload shims 124. The valve 102 includes a conical tip portion 126, a cylindrical needle portion 128, an annular convex surface portion 130 positioned in the cardioid chamber 121, a relatively larger diameter guide portion 132, a spring seat portion 134, and a stop portion 136. The valve 102 is movable between a first position at which the tip portion 126 is seated on valve seat 110, thereby blocking fluid communication between the fluid charge delivery passage 118 and the outlet 112, and a second position at which the tip portion 126 is upwardly spaced from the valve seat 110 thereby opening fluid communication.

The spring retainer 116 has a centrally disposed cavity 138, facing the fluid delivery opening 96 of the pump cylinder retainer 70, and houses a reverse-flow check valve 140. The check valve 140 in response to differential fluid pressure and gravity is movable between a first position at which the check valve 140 is spaced from the opening 96 and a second position at which the check valve 140 seats against the pump cylinder retainer 70 and blocks the opening 96.

The case 106 of the injector assembly 28 is preferably formed of a ductile metal having good heat conducting properties and is pressed or coined to the shape illustrated around the spray tip 108, spacer block 114, and spring retainer 116. The case 106 is substantially tubular and has a frusto-conical end portion 142 which mates with a frusto-conical end portion 144 of the spray tip 108. The case 106 and spacer block 114 define a fluid bleed-off passage 146 which communicates with the valve body bore 120 and the fluid leakage return means 98 of the pump cylinder retainer 70.

The second retaining means 30 includes a second cup-shaped nut or retainer 148 having a substantially tubular portion 150 with a longitudinally splined exterior surface 152 and a frusto-conical end portion 154 which is positioned in close proximity to the interiorly disposed cardioidal chamber 121 of the spray tip 108 and which seats against the internal frusto-conical seat 12 of the cylinder head 16. The first nut 68 has a second externally-threaded portion 156 which threadably mates with the tubular portion 150 of the second nut 148. An annular fluid seal 158 is provided adjacent the second threaded portion 156 and second nut 148. Once the second nut 148 is tightened, the injector assembly 28 is sealably and removably retained between the pump cylinder retainer 70 and the frusto-conical end portion 154 of the second nut 148. The sandwiched frusto-conical end portions 144,142,154 of the spray tip 108, case 106, and second nut 148, respectively, have the same included angles S,C,N and are selected from the range of about 40° to 80°, and, more preferably are about 50°.

This frusto-conical configuration of the end portions 144,142,154 in assembled cooperation with the tightened clamp 22 ensures adequate sealing between the seat 12 and these mating end portions relative to the combustion chamber. This configuration also induces a preselected compressive-stress state in the close proximity region of the spray tip 108 defining the cardioidal chamber 121, to prevent tensile-stress induced cracking and improve the fluid-pressure loading capability and fatigue life of that spray tip region, and yet prevent a loss of optimal guiding, sliding, and fluid leakage clearance between the bore 120 and the slidable valve guide portion 132 when the second nut 148 is tightened. Moreover, the angles S,C, and N are selected to prevent unacceptable stress in the inner surface of the second nut 148 when it is tightened.

INDUSTRIAL APPLICABILITY

While the operation of the present invention is believed clearly apparent from the foregoing description, further amplification will be made in the following brief summary of such operation.

In operation, a fluid, for example diesel fuel, is supplied under relatively low pressure to the annular reservoir 86 from the fuel manifold (not shown), through the annular space 92 and fluid supply port 88. In the position shown, the valve 102 is seated and the reciprocable plunger 34 is at the top of its stroke thereby uncovering the lower port 38 and allowing fuel to flow from the annular reservoir 92 into the pumping chamber 40 and fluid charge delivery passage 118. As the plunger 34 descends under the cooperative influence of the engine-driven rotatable camshaft 60, pushrod 58, pivotal rocker 56, and reciprocable follower 52, the plunger 34 first covers the lower port 38 and then pumps fuel through the internal channels 46,48, metering groove 50, out through upper port 36, and back to the annular fluid reservoir 86 until the metering groove 50 no longer communicates with the upper port 36. As the plunger 34 continues descending after the upper port 36 is blocked, the fuel pressure rises rapidly in both the pumping chamber 40 and the fluid charge delivery passage 118 until the high fuel pressure in the cardioidal chamber 121 acting on the exposed annular surface portion 130 of the valve 102 is sufficient to slightly lift the resiliently biased valve 102 off its seat 110 thereby additionally exposing the conical tip portion 126 of the valve 102 to high fuel pressure.

The needle valve 102 continues to be lifted inwardly away from the valve seat until its stop portion 136 abuts the spring retainer 116. When the valve 102 is unseated from the valve seat 110, high pressure fuel is injected into the combustion chamber (not shown) through the outlets 112. The injection continues under the influence of the downwardly moving plunger 34 until the metering groove 50 communicates with the lower port 38 thereby bypassing the remaining fuel in the pumping chamber 40 to the annular reservoir 86 and relieving the high fuel pressure which then allows the spring 122 to seat the valve 102 and terminate fuel injection until the cycle is repeated.

The modular design of the unit fluid pump-injector, having one threaded joint which removably and sealably clamps the pump cylinder 32 between the pump cylinder retainer 70 and the housing 18 and another threaded joint which removably and sealably clamps the injector assembly 28 to the pump cylinder retainer 70, advantageously is less prone to high pressure fuel leakage or to having the plunger bind during assembly since fewer parts are stacked and clamped together.

The modular design also advantageously allows merely the second nut 148 to be threadably unfastened from the first nut 68 so that the injector assembly 28 can be removed, for easier servicing or replacement, from the small diameter bore 76 of the first nut 68 without requiring removal of the first nut 68 or altering the position or arrangement of the pump assembly 20 relative to the first nut 68.

Conversely, the housing 18 may be threadably removed from the first nut 68 so that the pump assembly 20 can be removed from the large diameter bore 72 of the first nut 68 without requiring removal of the second nut 148 or altering the position or arrangement of the injector assembly 28 relative to the first nut 68.

The configuration of the injector assembly 28 advantageously allows the spray tip 108, spacer block 114, spring retainer 116, and resilient biasing means 104 to be clamped together in a test fixture for testing, adjustment, and close control of desired operating characteristics such as fuel flow rate, valve lift, and valve opening fuel pressure. Afterwards these parts are substantially encapsulated and retained against separation by the tamper proof case 106. The injector assembly 28 may then be coded for identification of its operating characteristics and selectively installed as a new or replacement part in a new or rebuilt unit fuel pump-injector.

The sandwiched frusto-conical end portions 154,142,144 of the second nut 148, case 106, and spray tip 108, respectively, which seat at surface 12 in the bore 14 of the cylinder head 16 provide a tight seal against carbon formation from the combustion chamber thus facilitating easier removal and servicing of the injector assembly 28. Moreover, the sandwiched frusto-conical end portions in seated cooperation with the tightened clamp 22 and cylinder head seat 12 create a preselected compressive stress state in the close proximity region of the spray tip 108 defining the cardioidal chamber 121 to prevent cracking and improve the fluid-pressure loading capability and fatigue life of that spray tip region.

Other aspects, objects and advantages of this invention can be obtained from a study of the drawings, the disclosure, and the appended claims.

I claim:

1. A unit fluid pump-injector assembly (10) comprising:

a housing (18);

a pump assembly (20) including a pump cylinder (32) and a reciprocable plunger (34) therein for developing an injection charge of pressurized fluid;

an encapsulated injector assembly (28) for injecting the charge of fluid out of the unit fluid pump-injector assembly (10), said encapsulated injector assembly (28) including a valve body (100) having a valve seat (110) and a spray orifice (112), a valve (102) positioned within the valve body, means (104) for resiliently biasing the valve against the valve seat, and a formed case (106) encapsulating the valve body and the resilient biasing means and retaining them against separation;

first means (26) for removably retaining the pump cylinder (32) against the housing (18) so that the pump assembly (20) may be removed from or assembled to the first retaining means (26) without altering the position or arrangement of the encapsulated injector assembly (28) relative to the first retaining means, said first retaining means (26) including a sleeve-type retainer (68) removably fastened to said housing (18); and second means (30) for removably retaining the encapsulated injector assembly (28) against the first retaining means (26) so that the encapsulated injector assembly (28) may be removed from or assembled solely as a unit to the first retaining means (26) without altering the position or arrangement of the pump assembly (20) relative to the first retaining means, said second retaining means (30) including a cup-shaped retainer (148) removably fastened to said sleeve-type retainer (68).

2. A unit fluid pump-injector assembly (10) comprising:

a housing (18);

a pump assembly (20) including a pump cylinder (32) and a reciprocable plunger (34) therein for developing an injection charge of pressurized fluid;

an encapsulated injector assembly (28) for injecting the charge of fluid out of the unit fluid pump-injector assembly (10), said encapsulated injector assembly (28) including a valve body (100) having a valve seat (110) and a spray orifice (112), a valve (102) positioned within the valve body, means (104) for resiliently biasing the valve against the valve seat, and a formed case (106) encapsulating the valve body and the resilient biasing means and retaining them against separation;

first means (26) for removably retaining the pump cylinder (32) against the housing (18) so that the pump assembly (20) may be removed from or assembled to the first retaining means (26) without altering the position or arrangement of the encapsulated injector assembly (28) relative to the first retaining means, said retaining means (26) including a sleeve-type nut (68) screw-threadedly fastened to said housing (18); and second means (30) for removably retaining the encapsulated injector assembly (28) against the first retaining means (26) so that the encapsulated injector assembly (28) may be removed from or assembled solely as a unit to the first retaining means (26) without altering the position or arrangement of the pump assembly (20) relative to the first retaining means, said second retaining means (30) including a cup-shaped nut (148) screw-threadedly fastened to said sleeve-type nut (68).

3. A unit fluid pump-injector assembly (10) comprising:

a housing (18);

a pump assembly (20) including a pump cylinder (32) and a plunger (34) reciprocably disposed in the pump cylinder (32) for developing an injection charge of pressurized fluid;

an encapsulated injector assembly (28) for injecting the charge of fluid out of the unit fluid pump-injector assembly (10), said encapsulated injector assembly (28) including a valve body (100) having a valve seat (110) and a spray orifice (112), a valve (102) positioned within the valve body, means (104) for resiliently biasing the valve against the valve seat, and a formed case (106) encapsulating the valve body and the resilient biasing means and retaining them against separation;

first means (26) for removably retaining the pump cylinder (32) against the housing (18) wherein said first retaining means (26) includes a sleeve-type nut (68) screw-threadably fastened to said housing (18), said sleeve-type nut having a pair of axial bores (72,76) wherein said pump assembly (20) is positioned within one (72) of the bores and said encapsulated injector assembly (28) is positioned in the other one (76) of the bores, said first retaining means (26) further including means (70) for separating the pump assembly (20) from the encapsulated injector assembly (28) so that the pump assembly (20) may be removed from or assembled to the first retaining means (26) without altering the position or arrangement of the encapsulated injector assembly (28) relative to the first retaining means, said pump cylinder (32) being positioned in the sleeve-type nut (68) and being sealedly retained between the housing (18) and the separating means (70); and second means (30) for removably retaining the encapsulated injector assembly (28) against the separating means (70) of the first retaining means (26) so that the encapsulated injector assembly (28) may be removed solely as a unit from or assembled solely as a unit to the first retaining means (26) without altering the position or arrangement of the pump assembly (20) relative to the first retaining means (26), said second retaining means (30) including a cup-shaped nut (148) screw-threadedly fastened to said sleeve-type nut (68), said encapsulated injector assembly (28) being sealedly retained between the cup-shaped nut (148) and the seaparating means (70).

4. A unit fluid pump-injector assembly (10) comprising:

a housing (18);

a pump assembly (20) including a pump cylinder (32) and a reciprocable plunger (34) therein for developing an injection charge of pressurized fluid;

an encapsulated injector assembly (28) for injecting the charge of fluid out of the unit fluid pump-injector assembly (10), said encapsulated injector assembly (28) including a valve body (100) having a valve seat (110) and a spray orifice (112), an inwardly-opening needle valve (102) positioned within the valve body, means (104) for resiliently biasing the needle valve against the valve seat, and a formed case (106) encapsulating the valve body and the resilient biasing means and retaining them against separation;

first means (26) for removably retaining the pump cylinder (32) against the housing (18) so that the pump assembly (20) may be removed from or assembled to the first retaining means (26) without altering the position or arrangement of the encapsulated injector assembly (28) relative to the first retaining means, said first retaining means (26) including a pump cylinder retainer (70) and a sleeve-type nut (68) screw-threadedly fastened to said housing (18), said sleeve-type nut having a pair of stepped coaxial bores (74,76) defining an annular shoulder (78) wherein said pump cylinder retainer (70) is positioned within one (74) of the bores and is sealedly seated against the annular shoulder, said pump cylinder (32) being positioned in the sleeve-type nut (68) and being sealedly retained between the housing (18) and the pump cylinder retainer (70); and second means (30) for removably retaining the encapsulated injector assembly (28) against the first retaining means (26) so that the encapsulated injector assembly (28) may be removed from or assembled solely as a unit to the first retaining means (26) without altering the position or arrangement of the pump assembly (20) relative to the first retaining means (26), said second retaining means (30) including a cup-shaped nut (148) screw-threadedly fastened to said sleeve-type nut (68), said encapsulated injector assembly (28) being positioned in the other on (76) of said bores and being sealedly retained between the cup-shaped nut (148) and the pump cylinder retainer (70).

5. The unit fluid pump-injector assembly (10) according to claim 4, wherein the pump cylinder retainer (70) includes a passage (98) for returning fluid leakage from the injector assembly (28) to an annular fluid reservoir (86) surrounding the pump cylinder (32).

6. A unit fluid pump-injector assembly (10) comprising:

a housing (18);

a pump assembly (20) including a pump cylinder (32) and a reciprocable plunger (34) therein for developing an injection charge of pressurized fluid;

an encapsulated injector assembly (28) for injecting the charge of fluid of the unit fluid pump-injector assembly (10), said encapsulated injector assembly (28) including a valve body (100) having a valve seat (110) and a spray orifice (112), an inwardly-opening needle valve (102) positioned within the valve body, means (104) for resiliently biasing the needle valve against the valve seat, and a formed case (106) encapsulating the valve body and the resilient biasing means and retaining them against separation, said valve body (100) and said case (106) having mated frusto-conical end portions (144,142);

first means (26) for removably retaining the pump cylinder (32) against the housing (18) so that the pump assembly (20) may be removed from or assembled to the first retaining means (26) without altering the position or arrangement of the encapsulated injector assembly (28) relative to the first retaining means, said first retaining means (26) including a pump cylinder retainer (70) and a sleeve-type nut (68) screw-threadedly fastened to said housing (18), said sleeve-type nut having a pair of stepped coaxial bores (74,76) defining an annular shoulder (78) wherein said pump cylinder retainer (70) is positioned within one (74) of the bores and is sealedly seated against the annular shoulder, said pump cylinder (32) being positioned in the sleeve-type nut (68) and being sealedly retained between the housing (18) and the pump cylinder retainer (70); and second means (30) for removably retaining the encapsulated injector assembly (28) against the first retaining means (26) so that the encapsulated injector assembly (28) may be removed from or assembled solely as a unit to the first retaining means (26) without altering the position or arrangement of the pump assembly (20) relative to the first retaining means (26), said retaining means (30) including a cup-shaped nut (148) having a frusto-conical end portion (154) and being screw-threadedly fastened to said sleeve-type nut (68), said encapsulated injector assembly (28) being positioned in the other one (76) of said bores and being sealedly retained between the frusto-conical end portion (154) of the cup-shaped nut (148) and the pump cylinder retainer (70), said frusto-conical and portion (142) of the case (106) being sandwiched between the mating frusto-conical end portions (144,154) of the valve body (100) and the cup-shaped nut (148).

* * * * *

UNITED STATES PATENT AND TRADEMARK OFFICE

CERTIFICATE OF CORRECTION

PATENT NO. : 4,527,738

DATED : July 9, 1985

INVENTOR(S) : James L. Martin

It is certified that error appears in the above-identified patent and that said Letters Patent is hereby corrected as shown below:

Column 2, line 9 delete "observation" and substitute --operation--;

Column 3, line 36 delete "64a and" and insert --64 and a--;

Column 9, line 27 delete "on" and insert --one--;

Column 10, line 42 delete "and" and insert --end--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*